US006835010B1

(12) United States Patent
Piccinino, Jr. et al.

(10) Patent No.: US 6,835,010 B1
(45) Date of Patent: Dec. 28, 2004

(54) OUTSIDE LOAD DRUM PROCESSOR

(75) Inventors: Ralph L. Piccinino, Jr., Rush, NY (US); Daniel M. Pagano, Honeoye Falls, NY (US); Joseph A. Manico, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/688,653

(22) Filed: Oct. 18, 2003

(51) Int. Cl.[7] ..... G03D 3/04
(52) U.S. Cl. ..... 396/599; 396/633; 396/635
(58) Field of Search ..... 396/598, 599, 396/633–635; 355/27–29; 134/64 P, 122 P

(56) References Cited

U.S. PATENT DOCUMENTS 1,939,144 A * 12/1933 Simjian ..... 396/633

6,485,202 B1 11/2002 Piccinino, Jr. et al.

* cited by examiner

*Primary Examiner*—D. Rutledge
(74) *Attorney, Agent, or Firm*—David A. Norais

(57) ABSTRACT

A photographic processor is in the form of an outside load drum processor. The outside load drum processor includes a circular member that includes a first wall, a second wall and a side-wall that connects the first wall to the second wall and extends around a perimeter of the circular member. A flexible shield member is wrapped around an outer surface of the side-wall so that a processing path for photographic material to be processed is defined between at least the outer surface of the side-wall and the inner surface of the flexible shield member. The circular drum member is rotated for processing of photographic film within the processing path.

13 Claims, 15 Drawing Sheets

OUTSIDE LOAD DRUM PROCESSOR

CROSS REFERENCE TO RELATED APPLICATIONS

The present application is related to the following U.S. patents: U.S. Pat. No. 6,663,301 issued Dec. 16, 2003, entitled CHEMICAL DELIVERY SYSTEM FOR USE WITH A PHOTOGRAPHIC PROCESSOR AND METHOD OF OPERATION; U.S. Pat. No. 6,592,271 issued Jul. 15, 2003, entitled PROCESSING SOLUTION DELIVERY SYSTEM FOR USE WITH A PHOTOGRAPHIC PROCESSOR AND METHOD OF OPERATION; U.S. Pat. No. 6,619,862 issued Sep. 16, 2003, entitled THERMAL MANAGEMENT DRUM FOR A PHOTOGRAPHIC PROCESSOR; and U.S. Pat. No. 6,722,799 issued Apr. 20, 2004, entitled PHOTOGRAPHIC PROCESSING DRUM HAVING A CENTRALLY LOCATED PROCESSING SOLUTION DELIVERY SYSTEM.

FIELD OF THE INVENTION

The present invention relates to a photographic processor and method of operation.

BACKGROUND OF THE INVENTION

Photographic processors come in a variety of shapes and sizes from large wholesale processors to small micro-labs. As photographic processors become more and more technically sophisticated, there is a continued need to make the photographic processor as user friendly and as maintenance free as possible.

Current available photographic processors have shortcomings in that they tend to have a relatively high film processing time and require a relatively large amount of processing solution due to the design of the processor. Further, in conventional photographic processors, the loading of film onto the processor tends to involve complicated mechanisms such as adjustable rollers. Kodak Model H11 and Model 16K are rapid color processors for paper which utilize a drum design. However, these processors were limited to paper sheets which were manually fed one at a time.

U.S. Pat. No. 6,485,202 discloses an interior drum design in which film is inserted inside the drum for processing. In the arrangement of this patent, the film is inserted into the drum through a slot and thereafter, a disc positioned inside the drum is rotated so as to draw the film into the drum. Further, in an interior drum design as described in this patent, chemical solutions are applied inside of the drum and the drum is rotated so as to process the film. Thereafter, through the use of a series of transfer and drive assemblies, the film can be drawn out of the drum and led to a dryer and further downstream equipment such as a scanner.

With the interior design drum processor as noted above, mechanisms for inserting the film into the drum and withdrawing the processed film from the drum are necessary. Further, it is necessary to supply processing solution to the interior of the drum and a roller for agitating the solution within the drum to enhance processing is also recommended.

SUMMARY OF THE INVENTION

The present invention addresses some of the difficulties discussed above by the discovery of a novel, compact and portable photographic processor in the form of a circular member that defines an outside load drum processor. The design of the outside load drum processor of the present invention simplifies the loading of various types of photographic film such as APS and 35 mm film, because the film is loaded from the outside of the drum. With the design of the outside load drum processor of the present invention, a mechanism for inserting the film inside the drum is not needed.

The present invention further provides for an outside load drum processor design which permits the heating of the drum from the inside out, so as to provide for a more uniform heating surface and reduce the possibility of leaks on the heating device.

The present invention also provides for an outside load drum processor that eliminates the need to supply chemicals to the inside of the drum.

The present invention accordingly relates to a photographic processor which comprises a circular member that includes a first wall, a second wall and side wall connecting the first wall to the second wall and extending around a perimeter of the circular member; and a flexible shield member wrapped around an outer surface of the side wall. A processing path for photographic material to be processed is defined between at least the outer surface of the side wall and an inner surface of the flexible shield member.

The present invention further relates to a method of processing photographic material which comprises the steps of wrapping a flexible shield member around an outer surface of a circular member, with at least a portion of the circular member being adapted to be immersed in a processing solution provided in a solution tray; inserting a photographic material to be processed into a processing path defined between the outer surface of the circular member and an inner surface of the flexible shield member; and rotating the circular member so as to immerse sections of the photographic material in the processing path into the processing solution to process the photographic material.

DETAILED DESCRIPTION OF THE INVENTION

Figure 1A:
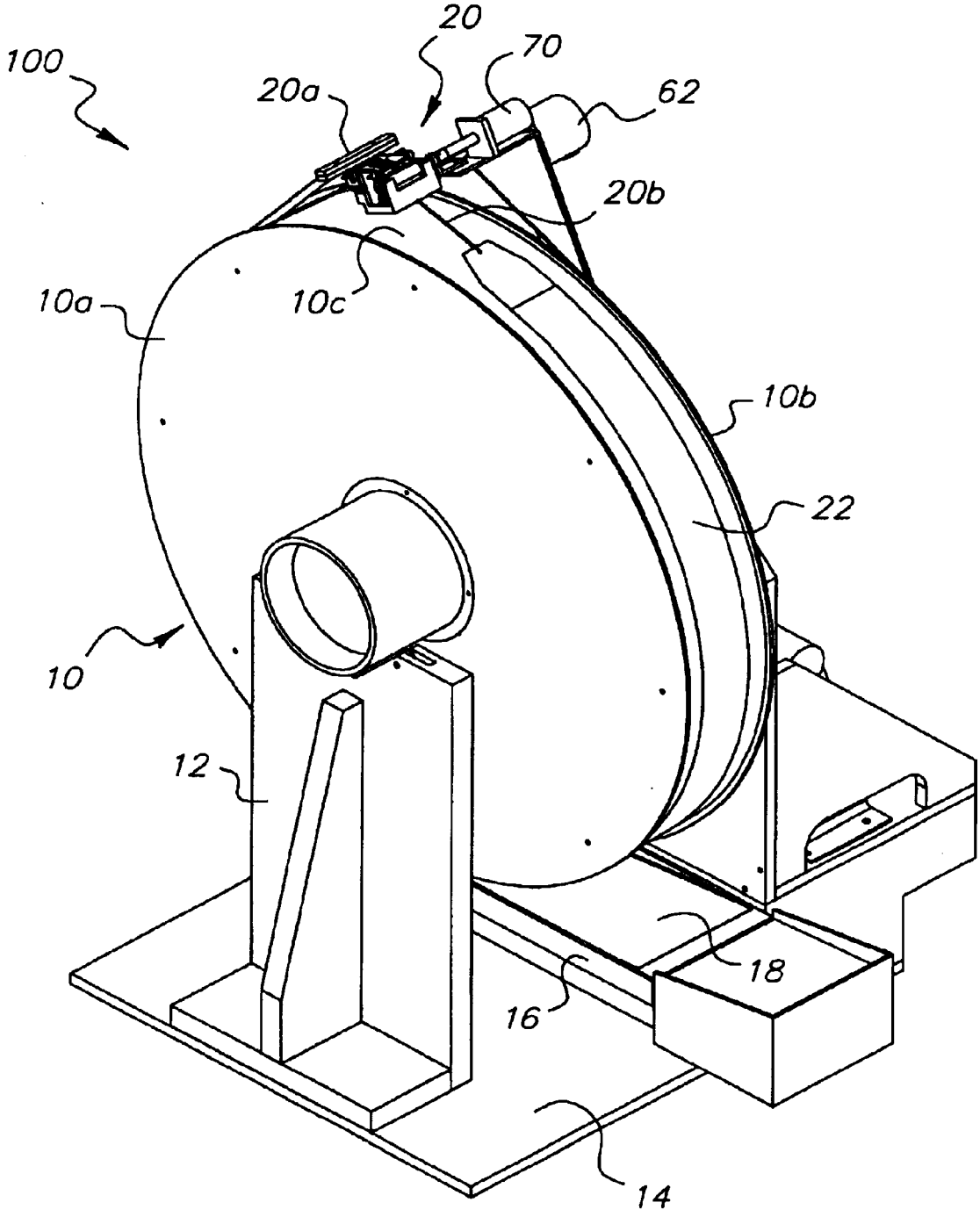
FIGS. 1A–1B are perspective views of opposite sides of an outside load drum processor in accordance with the present invention.
Figure 1B:
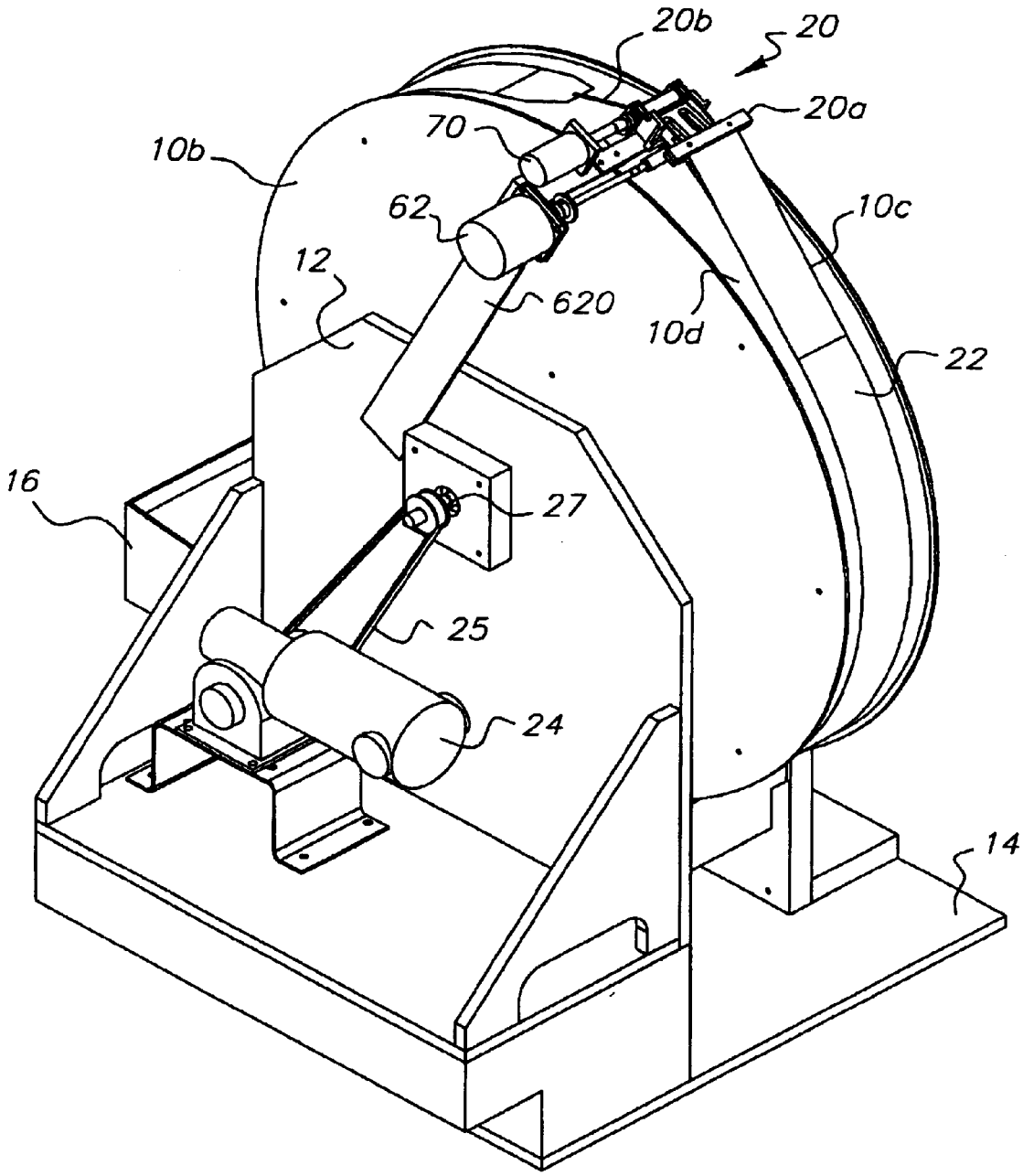

Referring now to the drawings, wherein like reference numerals represent identical or corresponding parts throughout the several views, FIG. 1A–1B are perspective views of an outside load drum processor in accordance with a first feature of the present invention. With reference to FIG. 1A, outside load drum processor 100 is shown. Outside load drum processor 100 includes a circular member 10 which comprises a first wall 10*a*, a second wall 10*b* (shown in the opposite view of FIG. 1B), and a side wall 10*c* which connects first wall 10*a* to second wall 10*b* and extends around a perimeter of circular member 10. Circular member 10 is rotatably mounted on a frame 12 which is mounted on a stand 14 as shown in FIGS. 1A–1B. Provided below circular member 10 is a solution tray 16 that is adapted to hold processing solution 18 therein. As shown in FIGS. 1A and 1B and also FIGS. 2A and 2B, circular member 10 is mounted on frame 12 in a manner in which a portion of circular member 10 is immersed within solution 18 in solution tray 16.

FIGS. 1A and 1B further show an assembly 20 which includes a clamp member 20*a* on one side and an attachment member such as wire or string 20*b* on an opposite side. Assembly 20 is mounted above side wall 10*c* as shown in FIGS. 1A, 1B. In a feature of the present invention, a flexible shield member 22 is wrapped around side wall 10*c* of circular member 10 in the manner shown in FIGS. 1A and 1B. More specifically, one end of flexible shield member 22 is clamped onto assembly 20 by way of clamp member 20*a*, and the second end of flexible shield member 22 is attached to the other end of assembly 20 by way of wire or string 20*b*. Flexible shield member 22 could be made of any flexible material which does not have an adverse reaction with solutions normally used in photographic processing. As an example, flexible shield member 22 could be made of plastic, vinyl mesh screen, film based materials or other flexible materials that are compatible with solutions normally used in photographic processing and does not damage the film base. With the use of flexible shield member 22 as shown in FIGS. 1A, 1B, a processing path 10*d* is defined between at least on outer surface of side-wall 10*c* and an inner surface of flexible shield member 22 for the placement therein and/or the passage therethrough of photographic material.

As also shown in FIG. 1B, processor 100 includes a motor 24 which drives a belt arrangement 25 attached to a shaft 27 of circular member 10. Therefore, actuation of motor 24 permits the rotation of circular member 10 through drive belt 25 and shaft 27 for processing of photographic material in processing path 10*d*. Although a belt type arrangement is shown in FIG. 1B, the present invention is not limited thereto. It is recognized that any type of mechanism which is adapted to rotate circular member 10 can be utilized. For example, motor 24 can rotate drum 10 via a single gear or a gear train.

In order to process photographic material using processor 100, the photographic material is inserted between flexible shield member 22 and side-wall 10*c* and wrapped around the outer surface of circular member 10 in a manner which will be described later. Once the photographic material is positioned around circular member 10 and held in place through flexible shield member 22, the drum which is partially immersed in solution tray 16 having solution 18 provided therein, is rotated by way of motor 24 to process the photographic material.

Figure 2B:
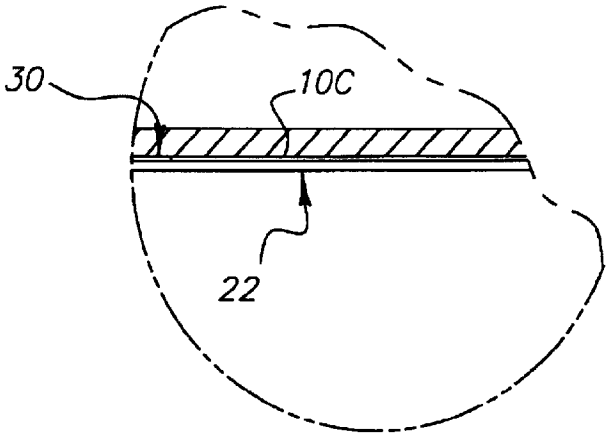
FIGS. 2A–2B are detailed views of a chemical solution tray or tank for the drum processor of the present invention.
Figure 2A:
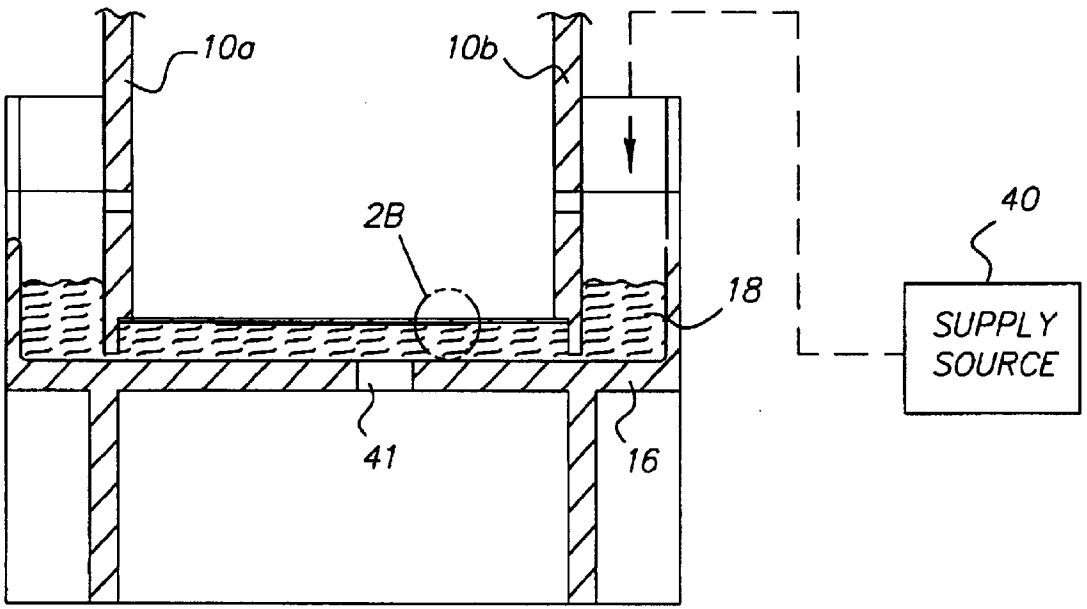

FIGS. 2A and 2B illustrate in more detail the features of solution tray 16. More specifically, as shown in FIG. 2A, solution tray 16 is adapted to receive and hold processing solution 18 therein. Processing solution 18 can be those solutions known in the photograph industry for processing photographic materials, such as developing solution, bleach solution, fixer solution, wash solution, etc. For processing, the appropriate solution can either be manually poured into solution tray 16 or can be supplied via, for example, a chemical supply source 40 and a metering member. Chemical supply source 40 could be a known solution cartridge or tank which is adapted to hold the necessary amount of processing solution for processing photographic material and can be adapted to supply and meter the appropriate amount of processing solution 18 into solution tray 16. Solution tray 16 can further include a discharge valve 41 for discharging the spent solution or wash solution from solution tray 16. Discharge valve 41 could be fluidly connected with a waste site or a further container for collecting waste solution.

FIG. 2B shows a closer view of the interrelationship between a photographic material 30 provided in processing path 10*d*, side-wall 10*c* of circular member 10 and shield member 22. As shown, when material 30 is in processing path 10*d*, it is held between shield member 22 and side wall 10*c* of circular drum 10.

Figure 3:
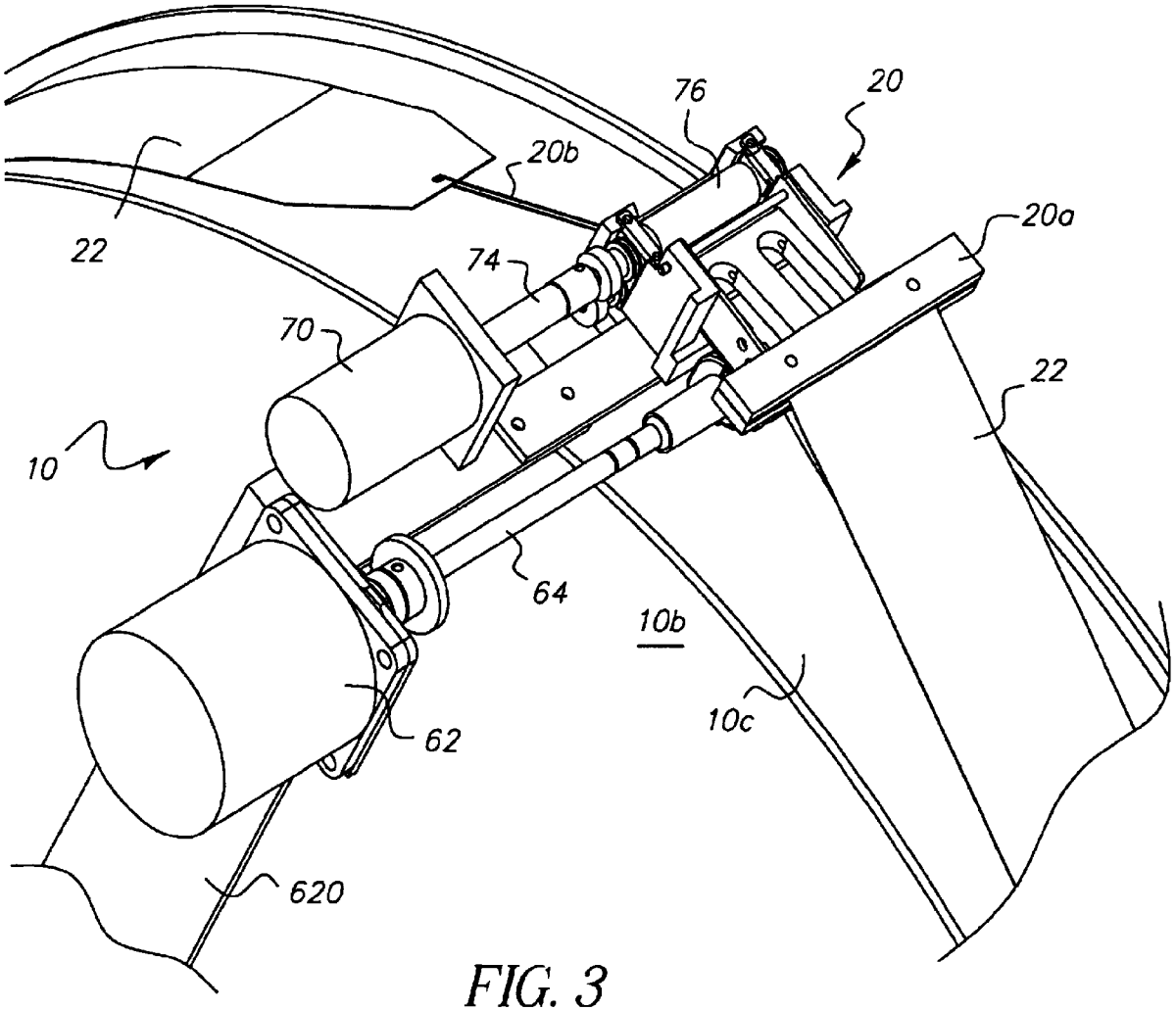
FIG. 3 is a detailed view of a section of the outside load drum processor showing an assembly utilized for inserting and/or withdrawing one type of film.

The processing of photographic material utilizing circular member 10 of the present invention will now be described with reference to FIGS. 1A and 1B and 3–6. A first example will be described with reference to processing a first type of photographic material which remains attached to its cartridge during processing, such as APS film. Referring to FIG. 3, assembly 20 is shown in detail, while flexible shield member 22 wrapped around drum 10 is also shown. Assembly 20 can be mounted on frame member 12 by way of an arm 620 (also see FIGS. 1A, 1B). For processing a first type of film such as APS film, assembly 20 includes a first drive mechanism in the form of a first motor 62 having a first shaft 64 operationally connected thereto.

Figure 4:
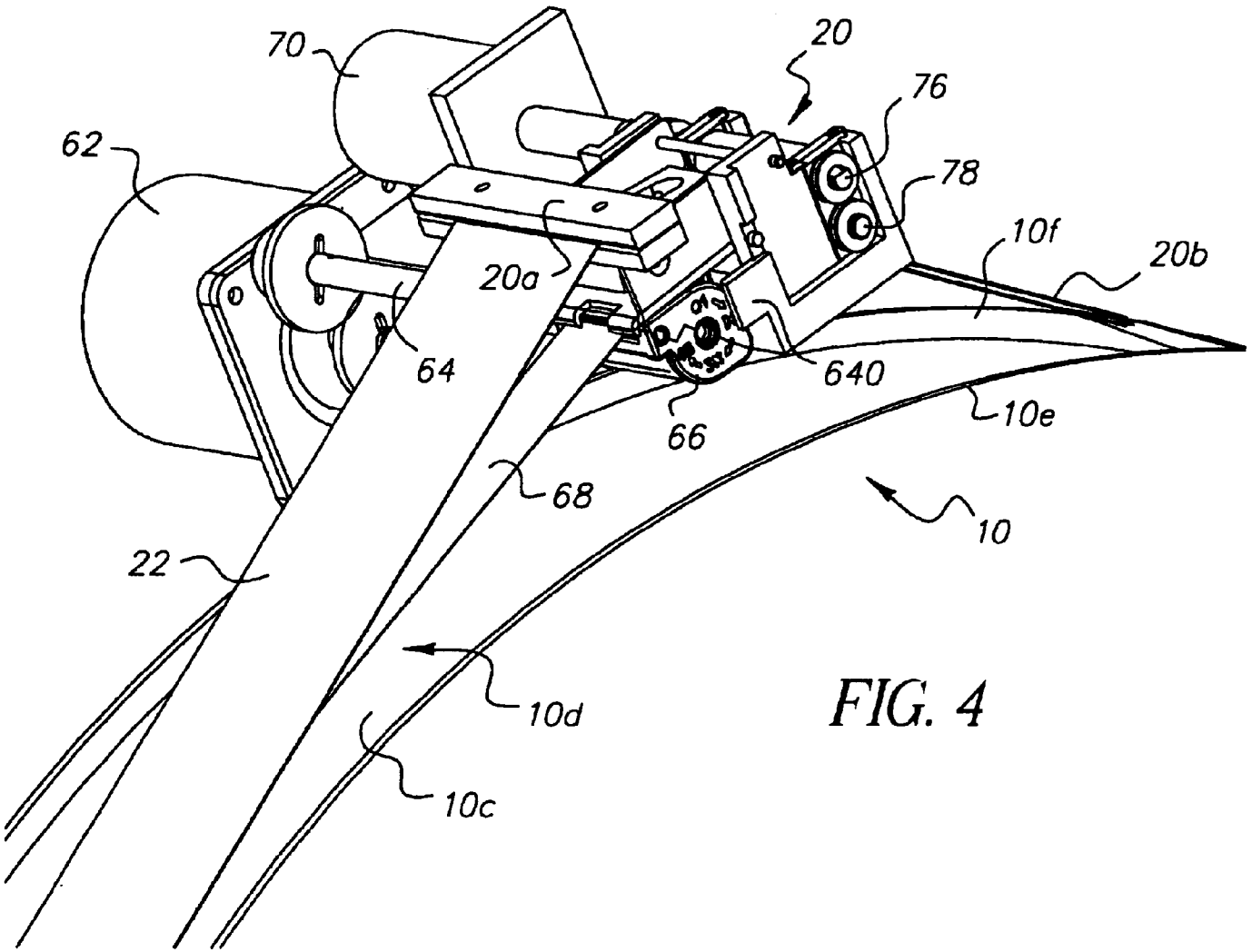
FIG. 4 is a view of the section shown in FIG. 3 from an opposite direction.

With reference to FIG. 4, it is seen that assembly 20 includes a support 640 for holding a cartridge such as an APS cartridge 66 thereon. Support 640 can be in the form of opposite plate members which frictionally hold cartridge 66 thereon. As a further option, the plate members for support 640 can be provided above and/or below cartridge 66 so as to clamp onto cartridge 66. Once cartridge 66 is mounted on assembly 20 as shown in FIG. 4, motor 62 and shaft 64 (FIG. 3) are operated to insert shaft 64 into the spindle of cartridge 66. At that point, motor 62 is actuated so as to drive or thrust film 68 (FIG. 4) out of cartridge 66 and into processing path 10*d* defined between the outer surface of side-wall 10*c* and the inner surface of flexible shield member 22 of processor 100. More specifically, processor 100 is designed such that flexible shield member 22 is wrapped around side wall 10*c* as shown in FIGS. 1A and 1B. Cartridge 66 loaded on assembly 20 cooperates with motor 62 to drive film 68 out of cartridge 66. At that point, film 68 will be driven between flexible shield member 22 and side-wall 10*c* in a manner in which film 68 will be wrapped around the circumference of circular member 10. Therefore, the film will be held between side wall 10*c* and flexible shield member 22. Additionally, end walls 10*f*, 10*e* (FIG. 4) extend from side wall 10*c* so as to provide a lateral boundary for film 68 in processing path 10*d*.

For processing, the appropriate processing solution is provided in solution tray 16 and circular member 10 is partially immersed in solution 18 within solution tray 16 as shown in FIG. 2A. Once photographic film 68 is located in processing path 10*d* as noted above, circular member 10 is rotated by actuating motor 24 so as to process the film and more specifically, cause a cooperation between processing solution 18 in tray 16 and film 68 provided in processing path 10*d* to develop the images on exposed photographic film 68. During the processing, the appropriate processing solutions are supplied and discharged into and from the processing tray for the processing of the photographic material. Further, after processing and/or between processing steps, a washing solution can be supplied to solution tray 16 so as to wash solution tray 16, film 68 and components of the processor which are adapted to be immersed in solution tray 16.

In a feature of the present invention, the structure of circular member 10 permits a heater to be inserted into drum 10. As a further option, heated air can be blown onto the drum. For example, heating material or elements could be embedded into or integrated on the inner surface of the drum; a blower could be adapted to blow heated air onto the inner surface of the drum prior to the film being loaded; or the drum could be plumbed with conduits running below the inner surface of the drum to permit the passage of heated fluid.

Figure 5:
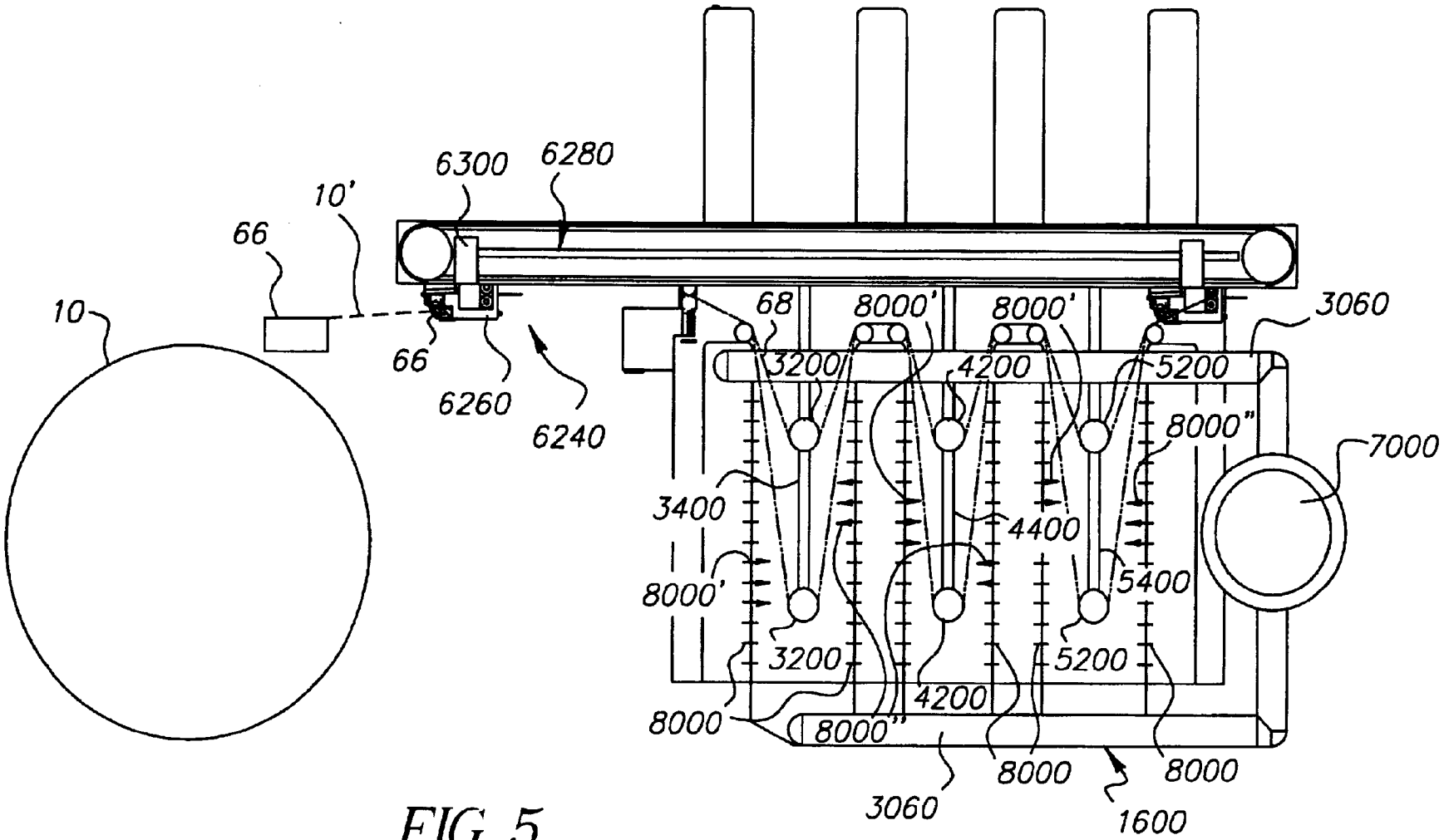
FIG. 5 is an illustration of a dryer which can be used with the processor of the present invention wherein a first type of film is dried.
Figure 6:
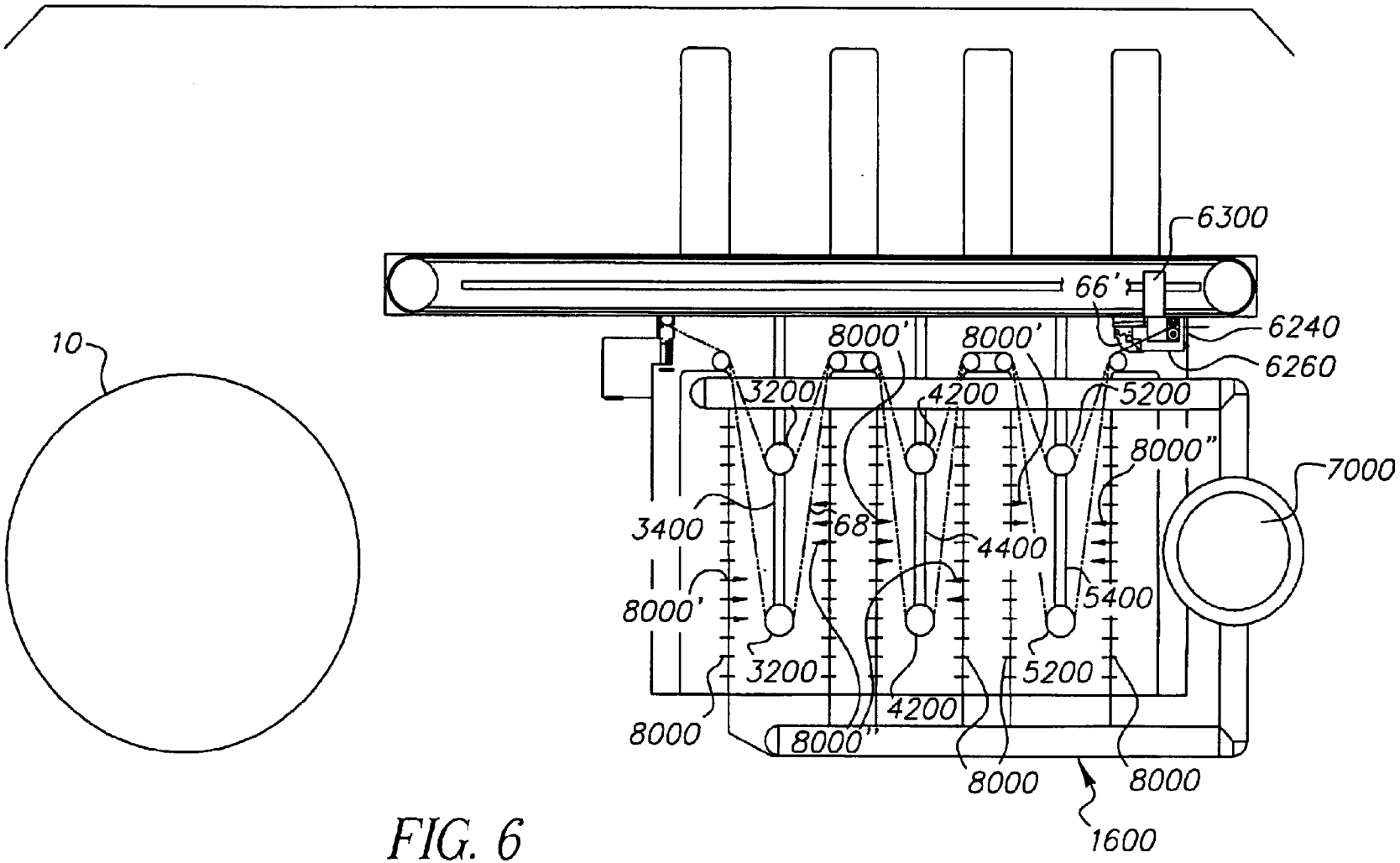
FIG. 6 is a further view of the dryer of FIG. 5.

After processing and washing, the film can be dried in a slack loop drying arrangement such as disclosed in co-pending application Ser. No. 10/421,429, the contents of which are herein incorporated by reference. That is, as shown in FIG. 5 which illustrates a dryer 1600, dryer 1600 can include a transfer assembly 6240 that comprises a support member 6260 as well as a transporting or driving mechanism 6280. The arrangement of FIG. 5 is applicable for drying film which remains attached to its cartridge during processing, such as APS film.

Support member 6260 includes a holding arrangement, a grabbing mechanism or a snap member which is adapted to grab and hold cartridge 66. In the embodiment of FIG. 5, drum 10 and cartridge 66 are schematically shown. Dash line 10' as shown in FIG. 5 represents the fact that cartridge 66 can be automatically transferred to dryer 1600 by adapting transfer assembly 6240 to grab and pull cartridge 66 from drum 10, or cartridge 66 can be manually removed from drum 10 and placed on transfer assembly 6240 by an operator.

Transfer assembly 6240 further includes a driving mechanism 6280 which can be a lead screw and/or a drive belt. The lead screw or drive belt is drivingly associated with a plate member 6300 which is attached to or integral with support member 6260. Movement of the lead screw or drive belt provides for the movement of plate member 6300 from the position illustrated in FIG. 5 to the position illustrated in FIG. 6. This places cartridge 66 (held by support member 6260) in a vicinity of an outlet of dryer 1600, while film 68 trailing therefrom spans across the top end of dryer 1600. At that point, adjustable rollers 3200, 4200 and 5200 are positioned above film 68 spanning across the top end of dryer 1600. Adjustable rollers 3200, 4200 and 5200 can then be moved along respective slots 3400, 4400 and 5400, depending upon the length of the photographic film, to any of a variety of positions along their respective slots to form slack loops in the film. For example, for shorter length film, rollers 3200, 4200 and 5200 can be placed in a middle position within slots 3400, 4400 and 5400. For longer length film, adjustable rollers 3200, 4200 and 5200 can be moved toward the bottom of slots 3400, 4400 and 5400. Thereafter, drying air supplied by air blower 7000 and ducts 3060 can be supplied to the slack loops through slots 8000 that extend along the slack loops. The drying air is basically supplied through slots 8000 in the directions schematically represented by arrows 8000', 8000".

Figure 7A:
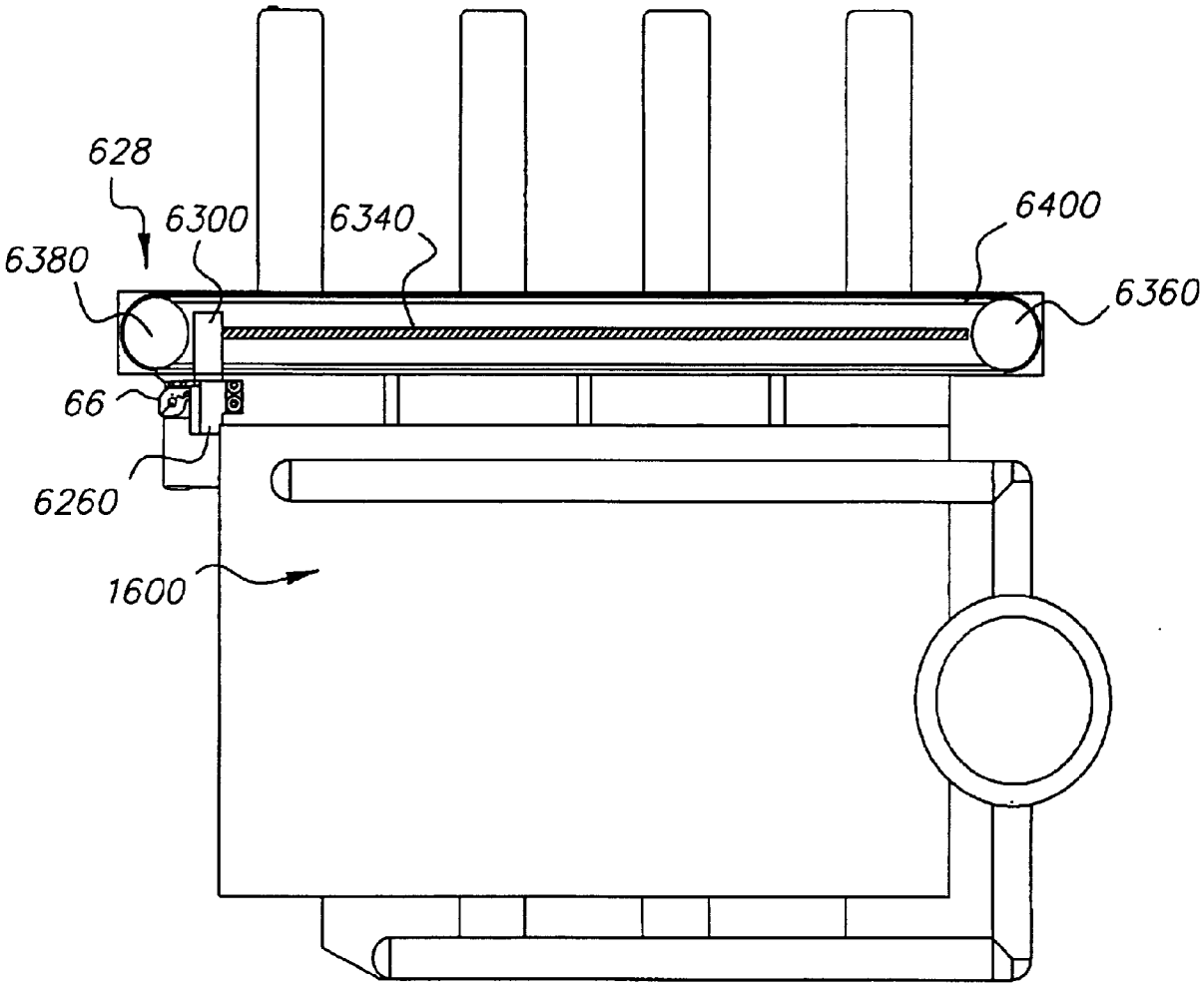
FIGS. 7A and 7B are still further views of the dryer of FIG. 5.
Figure 7B:
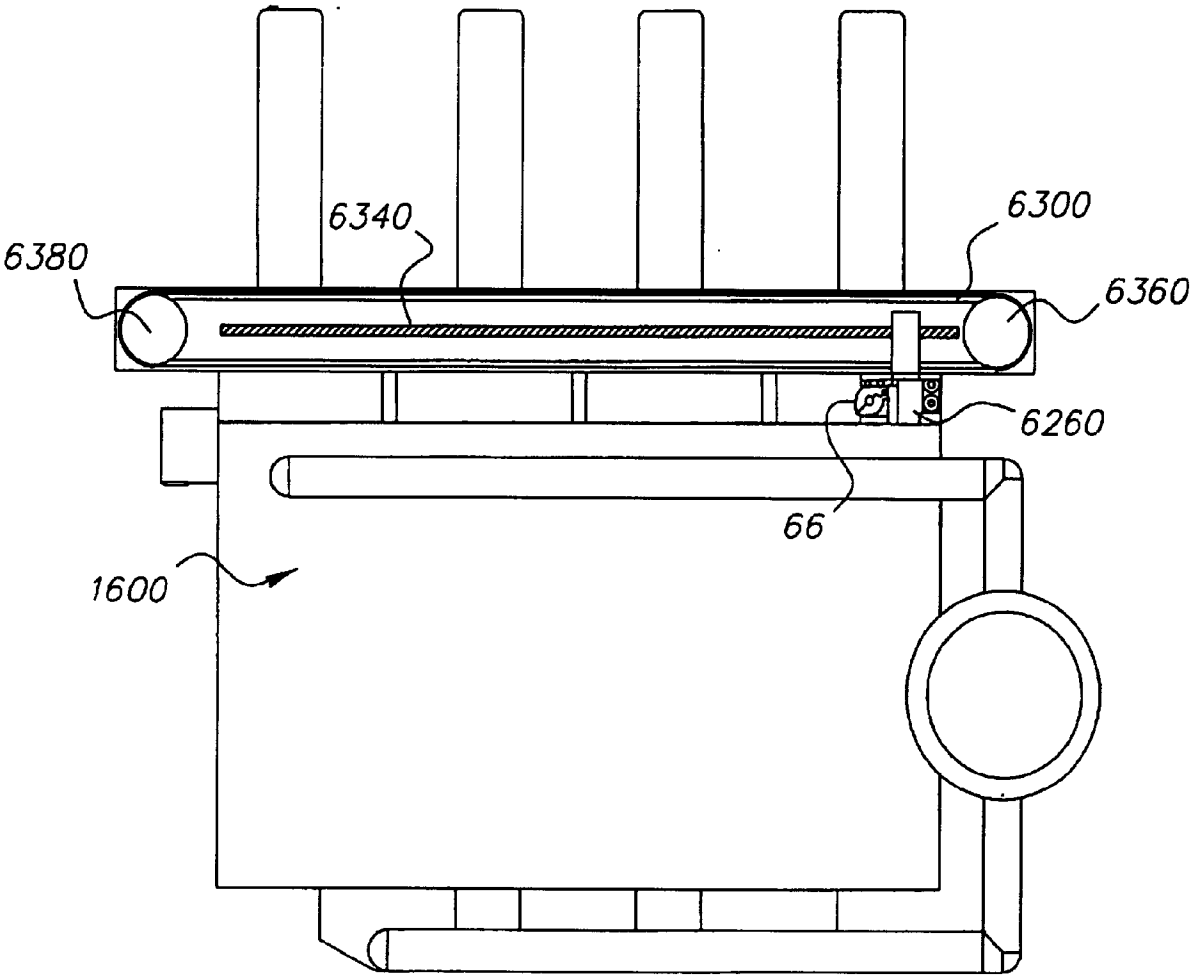

FIGS. 7A–7B illustrate features of the transfer assembly, support member and driving mechanism with reference to film which remains attached to its cartridge during processing, such as APS film. In the example of FIG. 7A, plate member 6300 is shown in the vicinity of an entrance to dryer 1600, and support member 6260 is shown holding APS cartridge 66. In one embodiment, plate member 6300 can be rotatably positioned on a lead screw 6340 such that rotation of lead screw 6340 causes a movement of plate member 6300 and a corresponding movement of support member 6260 in an axial direction along the top dryer of 1600. Depending on the rotation direction of a motor that drives lead screw 6340, support member 6260 can be driven back and forth between an entrance (FIG. 7A) and an exit (FIG. 7B) of dryer 1600 as shown in FIG. 7B.

As a further option for moving plate member 6300 and therefore, support member 6260, plate member 6300 can be attached to a endless conveyer belt 6400 which is wrapped around rollers 6360 and 6380. Rotation of at least one of rollers 6360, 6380 causes a corresponding movement of conveyer belt 6400 and therefore, a corresponding movement of plate 6300 between at least the positions shown in FIGS. 7A and 7B. Therefore, as describe in co-pending application U.S. Ser. No. 10/421,429, the film can be inserted and dried in dryer 1600, and thereafter prepared for further processing. Of course, this is just one example of a dryer which can be used to dry processed film in the present invention. It is recognized that other types of known film dryers can also be used. After the film is dried, it can be inserted back into cartridge 66, so that the film can be prepared for further downstream operations such as scanning.

Figure 8:
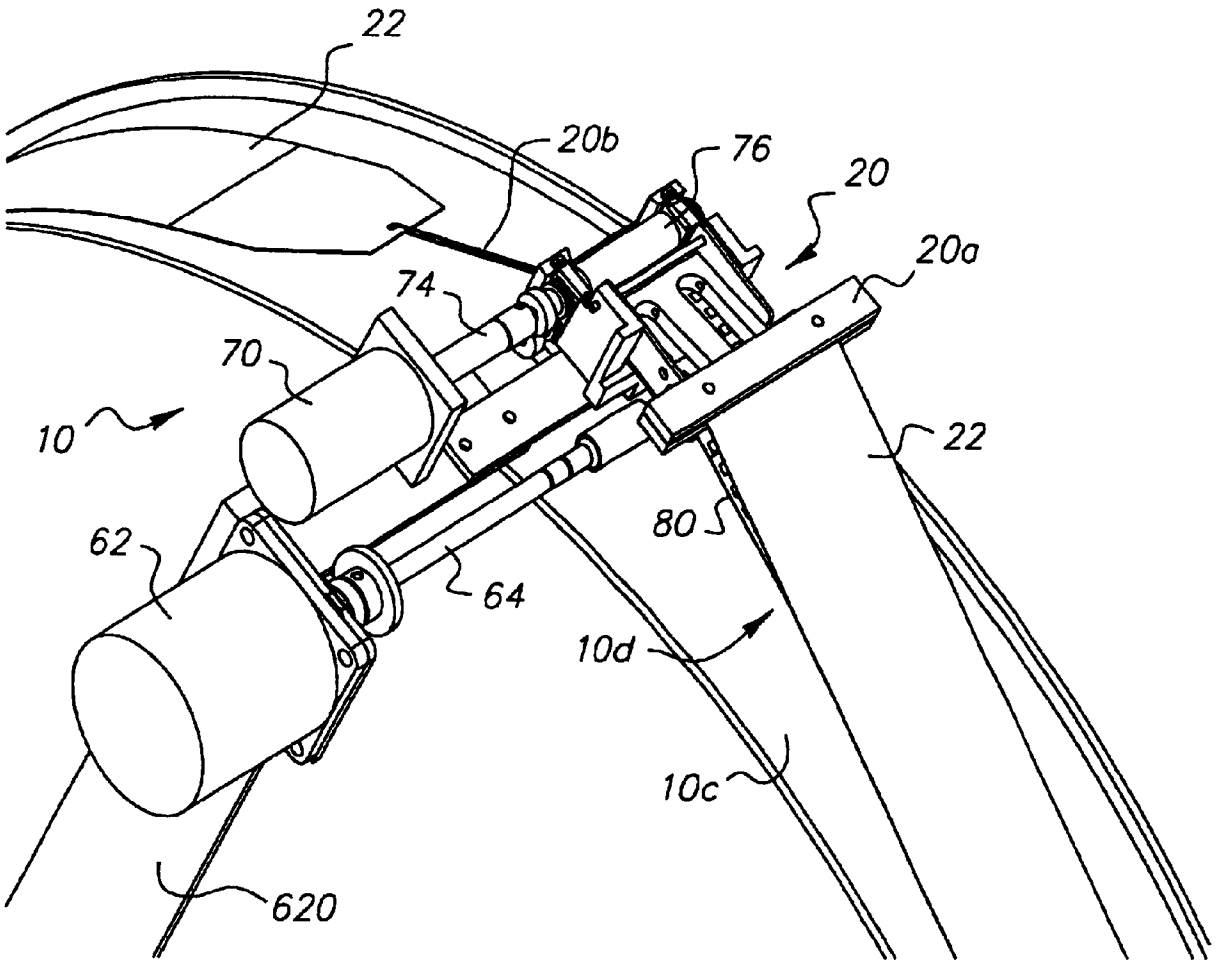
FIG. 8 is a view of a section of the outside load drum processor of the present invention wherein a different type of film is loaded onto the drum.
Figure 9:
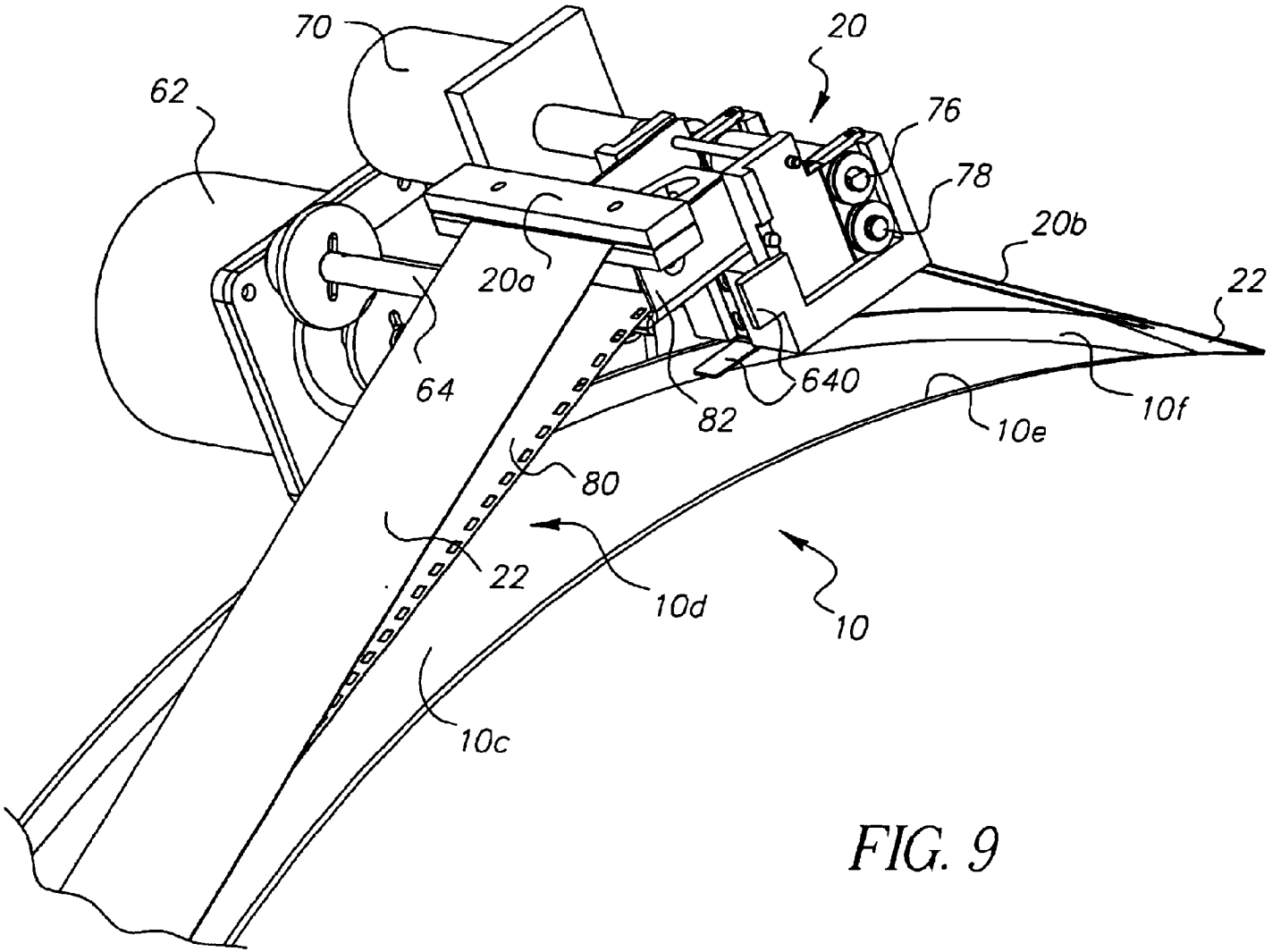
FIG. 9 is a view of the section of the drum processor of FIG. 8 as seen from the opposite side.

FIGS. 8 and 9 illustrate an embodiment of the present invention for processing a second type of photographic film which can be detached from its cartridge during processing, such as 35 mm film. For this purpose, assembly 20 includes a second drive mechanism in the form of a second motor 70 which is operationally connected with a second shaft 74. Second shaft 74 drives at least one of a pair of drive or pinch rollers 76, 78 which are more clearly shown in FIG. 9. Therefore, when it is desired to process, for example, 35 mm film, film 80 is inserted between rollers 76 and 78 which drives the film between flexible shield member 22 and side wall 10*c*. As film 80 is driven by rollers 76, 78, it passes through a section 82 of assembly 20 and into processing path 10*d* defined between at least flexible shield member 22 and side-wall 10*c*. Thereafter, film 80 is further driven so as to be wrapped around circular member 10. At this point, circular member 10 which is partially immersed in solution in solution tray 16 is rotated in the same manner as previously described with respect to APS film so as to process photographic film 80. Once processing is completed, motor 70 can be reversed to drive the processed film out of the circular drum member 10 and prepare the film for further downstream operations such as drying and scanning.

Figure 10:
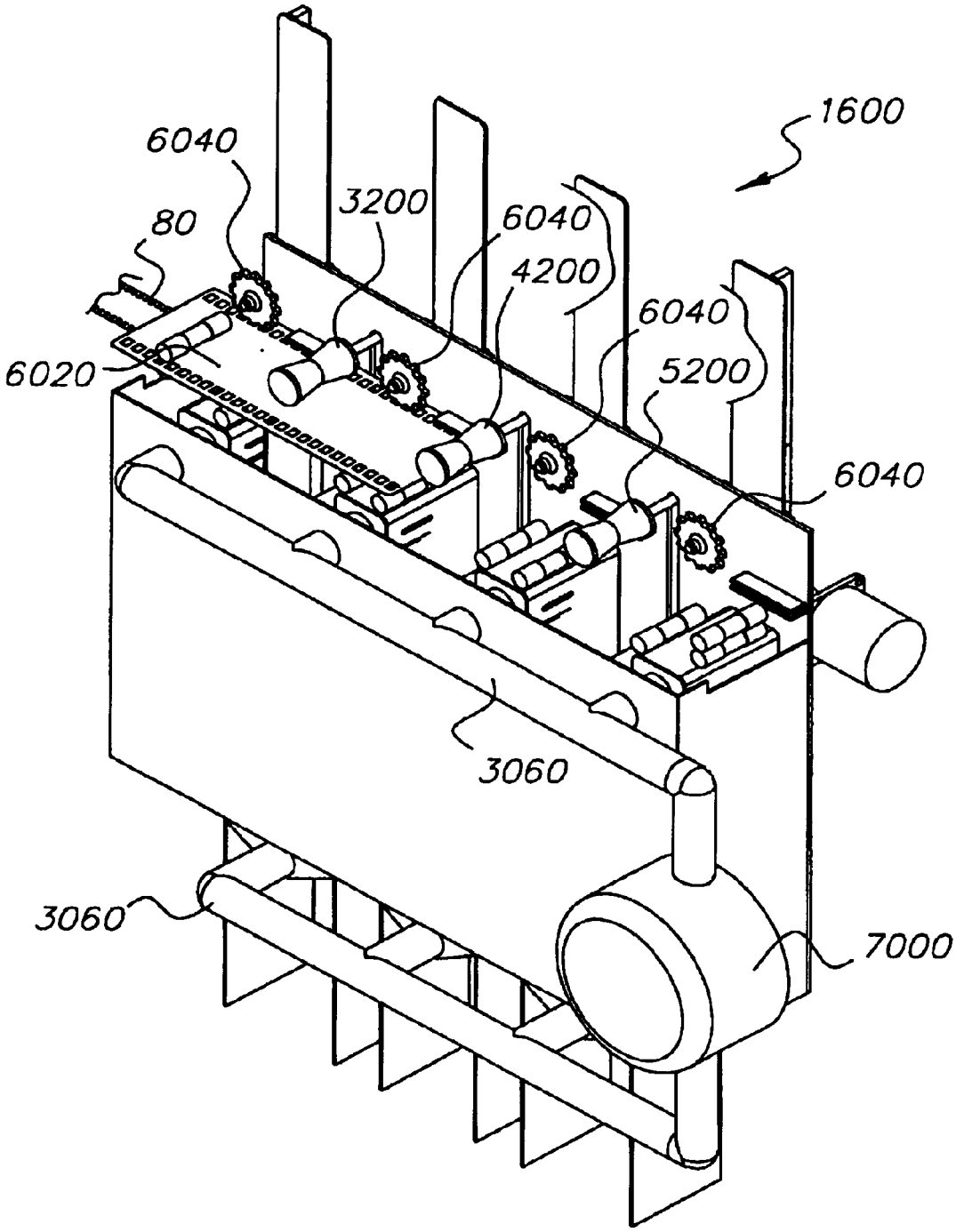
FIG. 10 is a further view of the dryer of FIG. 5 wherein a second type of film is dried.
Figure 11:
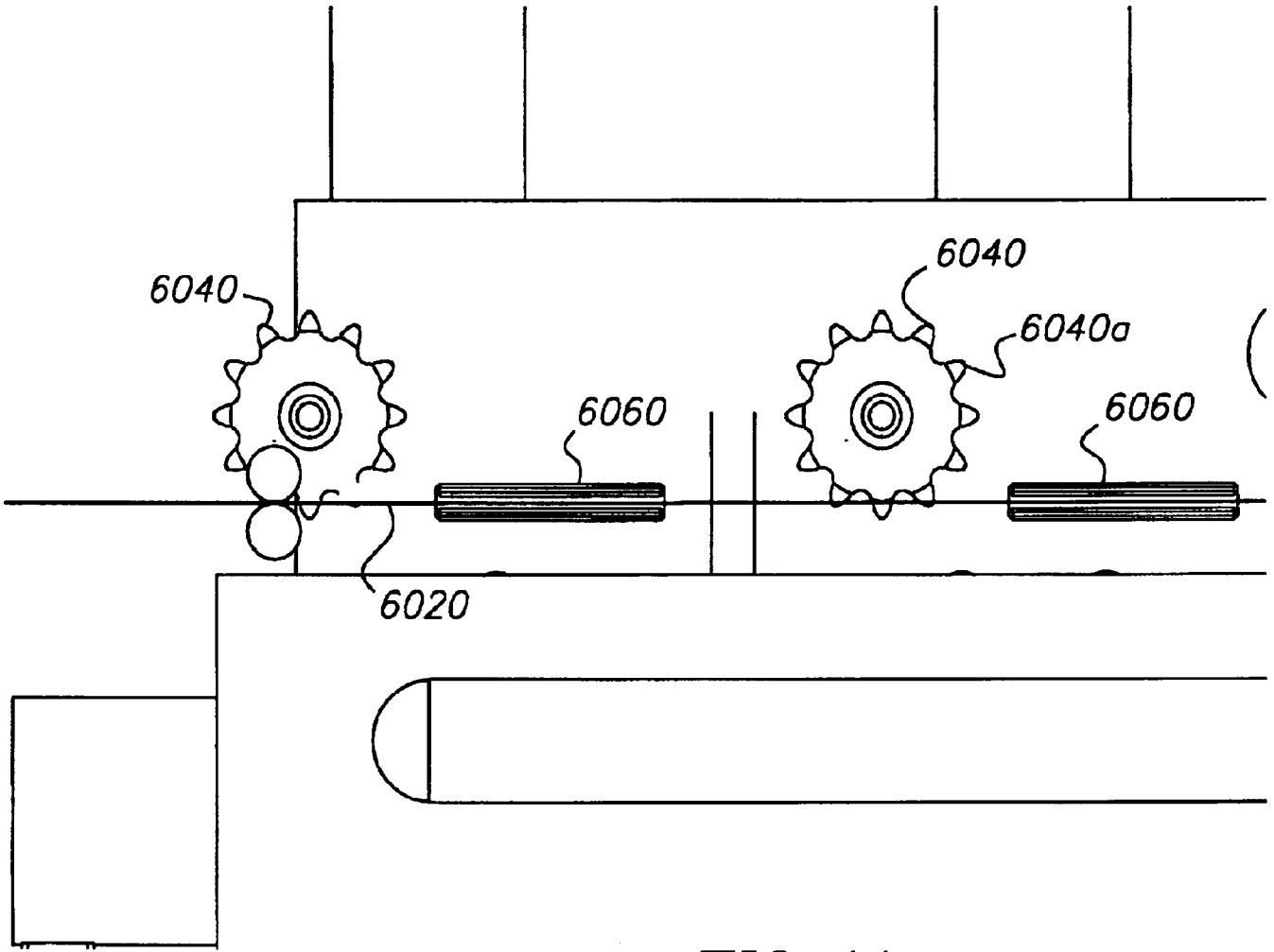
FIG. 11 is a view of a section of the dryer as shown in FIG. 10.

FIGS. 10–11 illustrate a dryer which can be used to dry film which can be detached from its cartridge during processing, such as 35 mm film, and is processed in accordance with the present invention. After being processed on member 10, film 80 can be associated with a leader card 6020 and manually or automatically inserted into dryer 1600 as shown in FIG. 10. As an example, the film can be manually transferred from the processor to the dryer by an operator; or an automatic transfer can be achieved through a transfer assembly similar to the assembly illustrated in FIGS. 7A and 7B, which includes motor driven rollers for driving the film from the processor to the dryer. Dryer 1600 is similar to the dryer described in co-pending application Ser. No. 10/421,429, the contents of which are herein incorporated by reference.

As shown in FIG. 10, dryer 1600 can include motor and chain driven sprockets 6040 which are adapted to cooperate with a side end of leader card 6020 in order to pull photographic film 80 into and through dryer 1600. More specifically, as illustrated in FIG. 11, sprockets 6040 include teeth 6040*a* which are adapted to mesh with perforations or holes in leader card 6020, so as to transport leader card 6020 through dryer 1600. As also shown in FIG. 11, dryer 1600 preferably includes guide grooves 6060 to help guide leader card 6020 through dryer 16.

Figure 12:
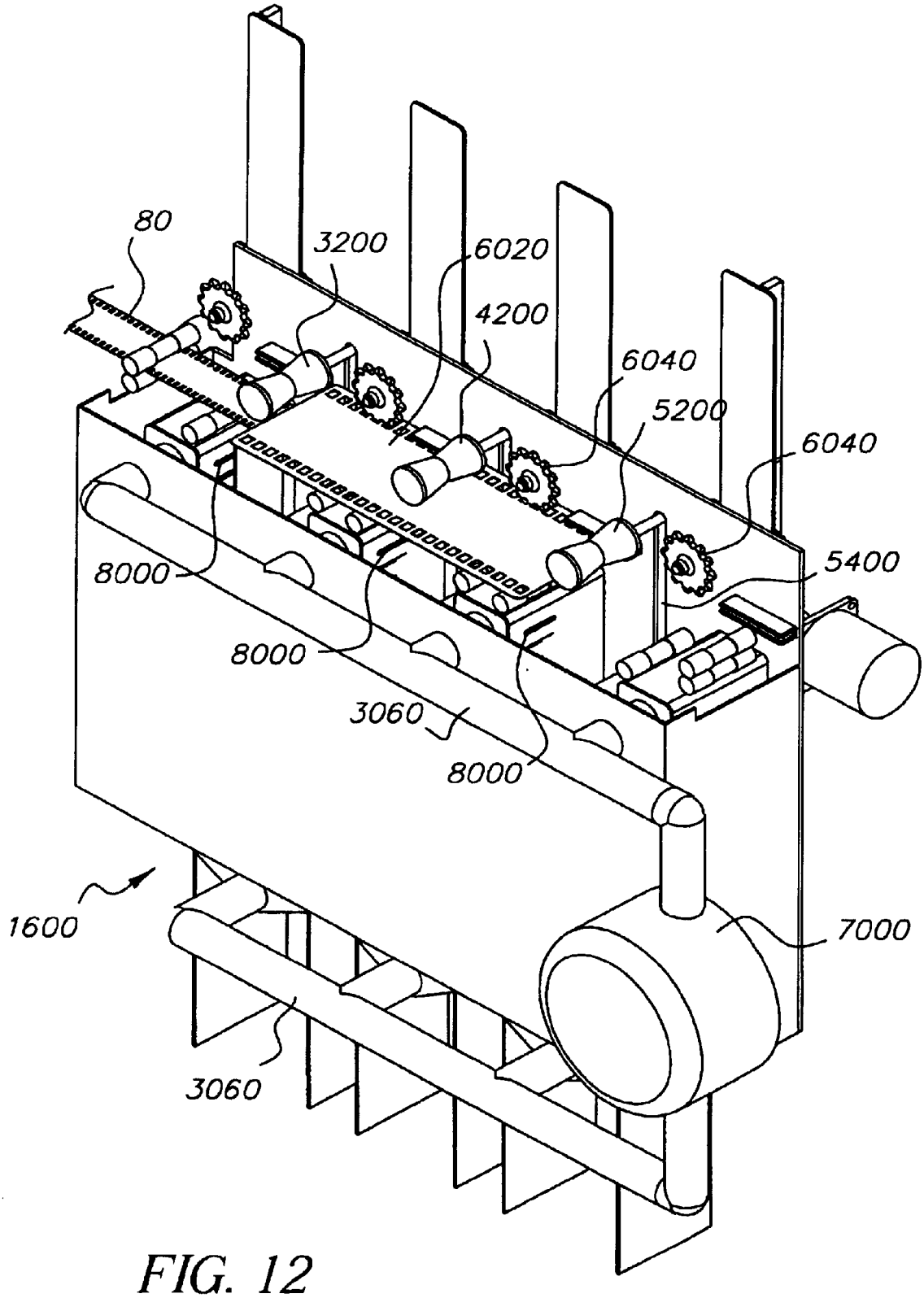
FIG. 12 is a further view of the dryer of FIG. 10.
Figure 13:
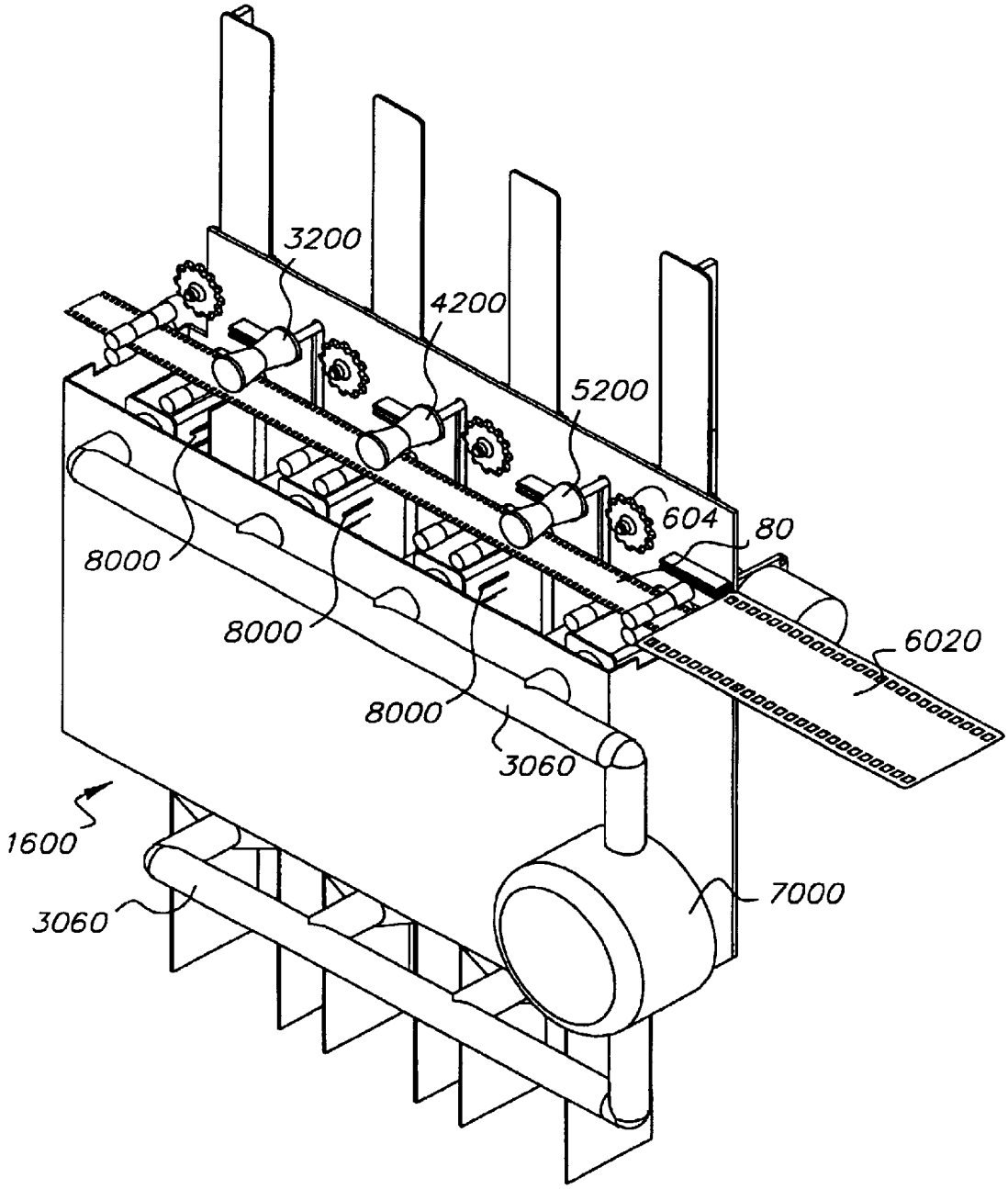
FIG. 13 is a still further view of the dryer of FIG. 10.

FIG. 12 illustrates leader card 6020 further along within dryer 1600 and illustrates processed photographic film 80 attached to leader card 6020 in a conventional manner. As leader card 6020 is driven by way of sprockets 6040, photographic film 80 is advanced into dryer 1600 to the position illustrated in FIG. 13. When film 80 is conveyed to the position shown in FIG. 13, adjustable rollers 3200, 4200 and 5200 are moved as described with reference to FIGS. 5–6, to a desired position along respective slots 3400, 4400 and 5400, in the manner as also described with reference to FIGS. 5–6 and also described in co-pending application Ser. No. 10/421,429. That is, each of adjustable rollers 3200, 4200 and 5200 are moved along their respective slots 3400, 4400 and 5400 (see FIG. 5), in accordance with the length of the film to be dried. Therefore, drying air supplied by air blower 7000 and ducts 3060 can be supplied to the slack loops through slots 8000 that extend along the slack loops.

Accordingly, the present invention provides for a photographic processor in the form of an outside load circular drum processor which facilitates the loading and unloading of photographic film. The outside load processor of the present invention eliminates the need for a mechanism to load film inside of a drum or processor, and also reduces tolerances needed to load film onto the inside of a drum. Although APS and 35 mm film are described, the present invention is not limited thereto. It is recognized that the processor of the present invention can process various types of film in addition to APS and 35 mm film.

The invention also permits the heating of the drum from the inside out which provides for a uniform heated surface and reduces the possibility of leaks on the heating device.

The present invention also eliminates the need to supply chemicals to the inside of a drum or processing tank. Also, with the design of the outside load drum processor of the present invention, it is possible to fill the solution tray with solution that can be heated in a rapid manner and while the drum is turning.

The invention has been described in detail with particular reference to certain preferred embodiments thereof, but it will be understood that variations and modifications can be effected within the spirit and scope of the invention.

What is claimed is:

1. A photographic processor comprising:

a circular member comprising a first wall, a second wall and a side wall connecting the first wall to the second wall and extending around a perimeter of the circular member;

a flexible shield member wrapped around an outer surface of said side wall, wherein a processing path for photographic material to be processed is defined between at least the outer surface of said side wall and an inner surface of said flexible shield member; and an assembly adapted to insert photographic material into said processing path and remove photographic material from said processing path.

2. A photographic processor according to claim 1, further comprising:

a solution tray positioned below said circular member, said solution tray being adapted to hold processing solution therein and being positioned such that at least a portion of the outer surface of the side wall and a corresponding portion of the flexible shield member is immersible in solution provided in said tray.

3. A photographic processor according to claim 2, further comprising:

a support member adapted to rotatably support said circular member in a manner in which said portion of the outer surface of the side wall and said corresponding portion of the flexible shield member are immersed in the solution in said tray, wherein the circular member is rotatable to rotate sections of photographic material located between the outer surface of said side wall and the flexible shield member into and out of said solution tray for processing of the photographic material.

4. A photographic processor according to claim 1, wherein:

said assembly comprises:

a support for a cartridge which holds a first type of photographic material therein; and a pair of rollers adapted to at least insert a second type of photographic material into said processing path.

5. A photographic processor according to claim 4, wherein said assembly further comprises:

a first driving member which cooperates with said cartridge to thrust the first type of photographic material in said cartridge into said processing path defined between said outer surface of said side wall and the inner surface of said flexible shield member for processing; and a second driving member which cooperates with said pair of rollers to rotate said pair of rollers and drive the second type of photographic material into said processing path defined between said outer surface of said side wall and the inner surface of said flexible shield member for processing.

6. A photographic processor according to claim 5, wherein:

said first driving member is further adapted to drive the processed first type of photographic material from said processing path back into said cartridge, and said second driving member is further adapted to drive the processed second type of photographic material from said processing path.

7. A photographic processor according to claim 4, wherein said assembly further comprises:

a clamping portion located on a first side of said assembly which clamps onto a first end of said flexible shield member, wherein a second end of said flexible shield member is attached to an opposing second side of said assembly.

8. A method of processing photographic material, the method comprising the steps of:

wrapping a flexible shield member around an outer surface of a circular member, at least a portion of said circular member being adapted to be immersed in a processing solution provided in a solution tray;

thrusting a photographic material to be processed from a cartridge into a processing path defined between the outer surface of said circular member and an inner surface of said flexible shield member; and rotating the circular member so as to immerse sections of the photographic material in said processing path into said processing solution to process the photographic material.

9. A method according to claim 8, wherein said wrapping step comprises the step of attaching opposite ends of the flexible shield member on an assembly mounted in the vicinity of the outer surface of the circular member.

10. A method according to claim 9, wherein said attaching step comprises clamping at least one of said opposite ends of said flexible shield member on one side of said assembly.

11. A method of processing photographic material, the method comprising the steps of:

wrapping a flexible shield member around an outer surface of a circular member, at least a portion of said circular member being adapted to be immersed in a processing solution provided in a solution tray;

using a pair of rollers to drive a photographic material to be processed into a processing path defined between the outer surface of said circular member and an inner surface of said flexible shield member; and rotating the circular member so as to immerse sections of the photographic material in said processing path into said processing solution to process the photographic material.

12. A method according to claim 11, wherein said wrapping step comprises the step of attaching opposite ends of the flexible shield member on an assembly mounted in the vicinity of the outer surface of the circular member.

13. A method according to claim 12, wherein said attaching step comprises clamping at least one of said opposite ends of said flexible shield member on one side of said assembly.

* * * * *